US007946048B1

(12) United States Patent
Sammut

(10) Patent No.: US 7,946,048 B1
(45) **Date of Patent: *May 24, 2011**

(54) SHOOTING CALIBRATION SYSTEMS AND METHODS

(75) Inventor: Dennis J. Sammut, Woodside, CA (US)

(73) Assignee: Horus Vision, LLC, San Bruno, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/768,359

(22) Filed: Apr. 27, 2010

Related U.S. Application Data

(63) Continuation of application No. 11/972,041, filed on Jan. 10, 2008, now Pat. No. 7,712,225.

(60) Provisional application No. 60/879,735, filed on Jan. 10, 2007.

(51) Int. Cl.
*F41J 1/00* (2006.01)

(52) U.S. Cl. ..... 33/506; 33/1 B; 273/409

(58) Field of Classification Search ..... 33/506, 33/563, 1 B; 273/408, 409; D22/113
See application file for complete search history.

(56) References Cited

U.S. PATENT DOCUMENTS

| | | | | |
|---|---|---|---|---|
| 197,397 | A | 11/1877 | O'Neil | |
| 252,240 | A | 1/1882 | Morris | |
| D14,355 | S | 10/1883 | Dressel | |
| 2,090,930 | A | 8/1937 | Schaffner | |
| 2,417,451 | A | 3/1947 | Schaffner | |
| D211,467 | S | 6/1968 | Wilbur | |
| 4,132,000 | A | 1/1979 | Dulude | |
| 4,244,586 | A | 1/1981 | Gorrow | |
| D288,465 | S | 2/1987 | Darnall et al. | |
| 5,181,719 | A | 1/1993 | Cleveland, III | |
| 5,415,415 | A | 5/1995 | Mujic | |
| 5,860,655 | A | 1/1999 | Starrett | |
| 5,920,995 | A | 7/1999 | Sammut | |
| 6,032,374 | A | 3/2000 | Sammut | |
| 6,049,987 | A | 4/2000 | Robell | |
| 6,213,470 | B1 | 4/2001 | Miller | |
| D455,811 | S | 4/2002 | Fedio, Jr. | |
| 6,453,595 | B1 | 9/2002 | Sammut | |
| 6,516,699 | B2 | 2/2003 | Sammut et al. | |
| 6,681,512 | B2 | 1/2004 | Sammut | |
| 7,712,225 | B2 * | 5/2010 | Sammut | 33/506 |
| 2005/0021282 | A1 | 1/2005 | Sammut et al. | |
| 2007/0044364 | A1 | 3/2007 | Sammut et al. | |
| 2008/0061509 | A1 | 3/2008 | Potterfield | |
| 2008/0098640 | A1 | 5/2008 | Sammut et al. | |
| 2010/0038854 | A1 * | 2/2010 | Mraz | 273/371 |

FOREIGN PATENT DOCUMENTS

WO WO 9601404 A1 * 1/1996

* cited by examiner

*Primary Examiner* — R. Alexander Smith
(74) *Attorney, Agent, or Firm* — Casimir Jones S.C.

(57) ABSTRACT

The present invention relates to target acquisition and related systems and devices, and more particularly to telescopic gunsights and associated equipment used to achieve shooting accuracy at, for example, close ranges, medium ranges and extreme ranges. The present invention also provides targets and methods of using the systems to achieve enhanced shooting accuracy.

18 Claims, 14 Drawing Sheets

1 # 2 # 3

NOT TO SCALE
GRAPHIC ILLUSTRATION

DATA CARD
FIRING SEQUENCE

| SHOT SEQUENCE NUMBER | NUMBER OF SHOTS AT THAT POSITION | ELEVATION MILS TMOA | WINDAGE MIL TMOA | SCORE | | | | | |
|---|---|---|---|---|---|---|---|---|---|
| | | | | 1/2" MOA | 1" MOA | 1 1/2" MOA | 2" MOA | 2 1/2" MOA | 2 1/2" + MOA |
| | | | | | | | | | |
| | | | | | | | | | |
| | | | | | | | | | |
| | | | | | | | | | |
| | | | | | | | | | |
| | | | | | | | | | |
| | | | | | | | | | |
| | | | | | | | | | |
| | | | | | | | | | |
| | | | | | | | | | |
| | | | | | | | | | |
| | | | | | | | | | |
| | | | | | | | | | |
| | | | | | | | | | |
| | | | | | | | | | |
| | | | | | | | | | |
| | | | | | | | | | |
| | | | | | | | | | |
| | | | | | | | | | |
| | | | | | | | | | |
| | | | | | | | | | |
| | | | | | | | | | |
| | | | | | | | | | |
| | | | | | | | | | |
| | | | | | | | | | |
| | | | | | | | | | |
| | | | | | | | | | |
| | | | | | | | | | |

FIG. 9

DATA CARD
FIRING SEQUENCE

| SHOT SEQUENCE NUMBER | NUMBER OF SHOTS AT THAT POSITION | ELEVATION MILS TMOA | WINDAGE MIL TMOA | SCORE | | | | | |
|---|---|---|---|---|---|---|---|---|---|
| | | | | 1/2" MOA | 1" MOA | 1 1/2" MOA | 2" MOA | 2 1/2" MOA | 2 1/2" + MOA |
| 1 | 2 | 0 | 0 | | | | | | |
| 2 | 1 | 0 | 2R | | | | | | |
| 3 | 1 | 0 | 2L | | | | | | |
| 4 | 1 | 2 | 0 | | | | | | |
| 5 | 1 | 2 | 3R | | | | | | |
| 6 | 1 | 2 | 3L | | | | | | |
| 7 | 1 | 5 | 0 | | | | | | |
| 8 | 1 | 5 | 3R | | | | | | |
| 9 | 1 | 5 | 3L | | | | | | |
| 10 | 1 | 10 | 0 | | | | | | |
| 11 | 1 | 10 | 3R | | | | | | |
| 12 | 1 | 10 | 3L | | | | | | |
| 13 | 1 | 15 | 0 | | | | | | |
| 14 | 1 | 15 | 3R | | | | | | |
| 15 | 1 | 15 | 3L | | | | | | |
| 16 | 1 | | | | | | | | |
| 17 | 1 | | | | | | | | |
| 18 | 1 | | | | | | | | |
| 19 | 1 | | | | | | | | |
| 20 | 1 | | | | | | | | |
| 21 | 1 | | | | | | | | |
| 22 | 1 | | | | | | | | |
| 23 | 1 | | | | | | | | |
| 24 | 1 | | | | | | | | |
| 25 | 1 | | | | | | | | |
| 26 | 1 | | | | | | | | |

Illustrative example of a test designed by a rifleman or instructor

FIG. 10

ANALYSIS OF PROBLEMS
(ENLARGEMENT - NTS)

(THIS EXAMPLE SHOWS A MIL CALIBRATED TARGET)

ANALYSIS OF PROBLEMS
(ENLARGEMENT - NTS)

SHOOTING CALIBRATION SYSTEMS AND METHODS

CROSS-REFERENCE TO RELATED APPLICATION

This application is a continuation of U.S. patent application Ser. No. 11/972,041 filed Jan. 10, 2008, which claims the benefit of priority to U.S. provisional application Ser. No. 60/879,735 filed Jan. 10, 2007, each of which are incorporated herein by reference in their entireties.

FIELD OF THE INVENTION

The present invention relates to target acquisition and related systems and devices, and more particularly to telescopic gunsights and associated equipment used to achieve shooting accuracy at, for example, close ranges, medium ranges and extreme ranges. The present invention also provides methods of using the systems for to achieve enhanced shooting accuracy.

BACKGROUND OF THE INVENTION

All shooters, whether they are police officers, soldiers, Olympic shooters, sportswomen and sportsmen, hunters, plinkers, or weekend enthusiasts have one common goal: hitting their target accurately and consistently. Accuracy and consistency in shooting depend largely on the skill of the shooter and the construction of the firearm and projectile.

The accuracy of a firearm can be enhanced by the use of precisely made components, including precisely-made ammunition, firearm components and target acquisition devices. It is well known in shooting that using ammunition in which the propellant weight and type, bullet weight and dimensions, and cartridge dimensions are held within very strict limits, can improve accuracy in shooting.

At very long ranges, in excess of 500 yards, however, the skill of the shooter and the consistency of the ammunition is often not enough to insure that the shooter will hit the target. As range increases, other factors can affect the flight of the bullet and the point of impact down range.

Other factors, such as wind, Magnus effect (i.e., a lateral thrust exerted by wind on a rotating bullet whose axis is perpendicular to the wind direction), projectile design, projectile spin, Coriolis effect, and the idiosyncrasies of the weapon or projectile can change the projectile's path over long range. Such effects are generally referred to as "windage" effects. Therefore, for example, to hit a target at long range, it may be necessary to correct for windage by moving the barrel of the weapon slightly to the left or the right to compensate for windage effects. When shooting East and West the elevation will be effected. Shooting due East, the bullet impact will be high. Shooting due West, the bullet impact will be low. The elevation at extended range might change slightly up or down depending on the spin of the projectile in a right hand or left hand twist barrel. Thus, for example, in order to hit a target at long range, the shooter must see the target, accurately estimate the range to the target, estimate the effect of bullet drop and windage effects on the projectile, and use this information to properly position the barrel of the firearm prior to squeezing the trigger.

In addition, conventional telescopic target acquisition devices are not generally useful at long ranges in excess of 400-800 yards. At close ranges less than 100 yards conventional target acquisition devices generally fall short when extreme accuracy is desired. The cross-hairs of such target acquisition devices are typically located in the center of the field, with the vertical hair providing a central indicator for making a windage adjustment, and the horizontal hair providing a central indicator for making a bullet drop adjustment. Modifications to this basic system have not, thus far, enabled a skilled shooter firing at long ranges to acquire and hit a target quickly and reliably, regardless of the weapon used (assuming always that the firearm is capable of reaching a target at the desired long range).

Regardless of range, and even with the best equipments, shooters seek to improve accuracy. Improvement may involve becoming familiar with a particular shooting system (weapon, scope, software, other accessories, etc.) and/or with a particular environment (e.g., distance, weather conditions, lighting, elevation, etc.).

What are needed are improved systems and methods for enhancing the accuracy of a shooter and for allowing a shooter to maintain accuracy and precision and/or to continuously improve accuracy and precision. Ideally, the systems and methods are useful across a wide range of different shooting systems and environments.

SUMMARY OF THE INVENTION

The present invention relates to target acquisition and related systems and devices, and more particularly to telescopic gunsights and associated equipment used to achieve shooting accuracy at, for example, close ranges, medium ranges and extreme ranges. The present invention also provides methods of using the systems for to achieve enhanced shooting accuracy. The systems and methods of the present invention permit a shooter to determine the shooting parameters of their particular system and to accommodate unique characteristics of the shooting system. The systems and methods of the invention provide an empiric solution to determine inherent and non-inherent problems associated with a shooting system or shooter, and to improve accuracy and precision, regardless of the cause of the problem.

In some embodiments, the system and method enable a shooter to collect data by shooting at a predetermined distance, whereby the information gained has direct value for improved shooting at much longer or shorter ranges without having to shoot at the longer or shorter ranges.

In some embodiments, the present invention provides a target. The target may be provided alone, as part of a set of targets (the same or different targets), and/or as part of a shooting system comprising other components. In some embodiments, the set of targets is provided on a shared medium, for example, paper or metal. In other embodiments, the set of targets is provided in mixed media. In still further embodiments, the target or set of targets is provided on computer readable media for the user to prepare a target surface, for example, by printing.

In some embodiments, the target is configured for shooting calibration and comprises marking configured to assess initial zeroing of a firearm. In some embodiments, the target also has marking configured to assess accuracy of a plurality of elevation adjustments. Preferably, the target and its markings are configured for use at a single or one or more predetermined distances from the shooter.

In some embodiments, the marking comprises primary vertical and horizontal lines intersecting (e.g., at a central position on the target), and a plurality of secondary horizontal lines at defined unit increments above and below the primary horizontal lines. In some embodiments, the primary vertical and horizontal lines intersect in a targeting box. In other embodiments, the primary vertical and horizontal lines are even in thickness within and outside of the targeting box. In further embodiments, the primary vertical and horizontal lines are uneven in thickness within and outside of the targeting box. In further embodiments, the primary vertical and horizontal lines and targeting box are configured to be visible at a specified distance, wherein secondary lines are not visible to the unaided vision of the user, or to the vision of the user aided by a specific target acquisition device. In some embodiments, the primary vertical and horizontal lines are solid lines. In other embodiments, the primary vertical and horizontal lines comprise smaller lines configured to appear as solid lines at a specified distance.

In some embodiments, the increments are defined by the elevation adjustments (e.g., defined by unit distances corresponding to elevation units of a particular target acquisition device used with the firearm). In some embodiments, the marking comprise numerical unit measurements, labeling the secondary lines. In some embodiments, the target further comprises a plurality of secondary vertical lines. In some embodiments, the secondary vertical lines are at defined unit increments to the left and right of the primary vertical line, the increments defined by windage adjustments. One or more of the secondary horizontal or vertical lines may be visible or invisible to the shooter at the predetermined distance (e.g., are of a thickness to be visible or not visible at the distance). In some embodiments, one or more of the intersections between the secondary vertical and horizontal lines are marked by a symbol. In other embodiments, the symbol marking the intersection between one or more secondary vertical and horizontal lines is a circle or one or more concentric circles. In some embodiments, the primary and secondary vertical and horizontal lines are evenly spaced. In other embodiments, the primary and secondary vertical and horizontal lines are unevenly spaced. In further embodiments, the primary and secondary vertical and horizontal are evenly and unevenly spaced in different zones of the target.

In some embodiments, the primary and secondary vertical and horizontal lines are continuous. In other embodiments, the primary and secondary vertical and horizontal lines are discontinuous. In further embodiments the primary and secondary vertical and horizontal lines are continuous and discontinuous in different zones of the target. In some embodiments, the discontinuous primary and secondary vertical and horizontal lines are interrupted at even intervals. In other embodiments, the discontinuous primary and secondary vertical and horizontal lines are interrupted at uneven intervals. In some embodiments, the primary and secondary vertical and horizontal lines comprise markings, for example, dots, triangles, squares, short lines, or rectangles in a linear orientation. In some embodiments, the markings are evenly spaced. In other embodiments, the markings are unevenly spaced. In other embodiments, the markings are filled. In further embodiments, the markings are unfilled. In other embodiments, the markings are black or white. In further embodiments, the markings are colored. In further embodiments, the primary and secondary vertical and horizontal lines comprise different markings in different zones of the target.

In some embodiments, the elevation and windage adjustments of the present invention comprise "clicks" of elevation and windage turret knobs of riflescope-type target acquisition devices. In other embodiments, the elevation, windage and cant adjustments of the present invention comprise modifications of analog or digital representations of the relationship between one or more aiming points of the target acquisition device and the target. The adjustments are not limited by any particular target acquisition device, or any particular mechanism of adjustment. In some embodiments, the adjustments are discrete. In other embodiments, the adjustments are continuous.

In some embodiments, the target further comprises marking that allow assessment of (e.g. validation of) cant. For example, the target may comprise an arc line, with or without numerical labeling, that permits the shooter to determine cant error. In some embodiments, the arc line is positioned such that its relative position to a shot that hits the target, reveals can error.

In some embodiments, the target further comprises markings that provide one or more bull's-eye markings. The bull's-eye markings may be of any size or shape desired (e.g., circles, squares, other geometric shapes, other shapes). In some embodiments, the bull's-eye comprises one or more circular shapes (e.g., concentric circles). In some embodiments, a plurality of bull's-eyes are provided on the target, at, for example, the zero position, along the primary horizontal or vertical lines (e.g., a predetermined distances), or along secondary horizontal or vertical lines (e.g., a predetermined distances).

In some embodiments, the target comprises two or more zones. In some embodiments, each zone has primary horizontal and vertical lines and/or any of the other markings described herein. In some embodiments, the target has two zones. In some embodiments, the target has three or more zones.

In some embodiments, the target comprises a zone for recording, including, but not limited to, shooting result information, information about the firearm, scope, reticle, cartridge, or other component of a shooting system that is used, information about the shooter, time, date, environmental conditions, lighting information, and the like. In some embodiments, the information comprises, but is not limited to, the date and time of shooting, the temperature, wind direction and distance, barometric pressure, the distance to the target, the rile, the rifle's caliber and serial number, the bullet make, weight, type, case length, powder used, primer used, group serial number of ammunition, chronograph velocity data, number of rounds fired and results.

In some embodiments, the external shape of the target is square or rectangular. In some embodiments, the external shape of the target is not square or rectangular. In other embodiments, the target is a circle. In further embodiments, the targets may be any geometric shape. The target is not limited by any particular shape. In some embodiments, the outer edge comprises a plurality of edges that are not parallel or perpendicular to any other edge.

The targets may be made of any type of material, including, but not limited to, paper, cardboard, fabric, metal, wood, ceramic, silicon, and the like. In some embodiments, the target is provided on a surface, for example, by printing or etching. In other embodiments, the target is projected on a surface from, for example, ahead of the surface, behind the surface, above the surface or below the surface. In further embodiments, the target is projected, for example, from the user or from behind the user. In some embodiments one or more sensors (e.g., pressure sensors, video equipments, etc.) is associated with the target to assess shooting. In some embodiments, software of computing equipment is used to collect shooting data, analyze data, store data, and/or report on data. Any one or more of the markings may be made via any method including, but not limited to, inking, etching, image projection, and the like. In some embodiments, the target is provided in a form that allows it to be easily stored or transported (e.g., in a rolled-up form).

In some embodiments, markings on the target are configured specifically for a particular shooting system employed by the shooter. For example, marking may account for non-linear adjustments of a particular scope, changes over time with a particular system, and the like. Thus, in some embodiments, the targets permit the shooter to monitor changes over time and either gain skill in view of those changes, or make appropriate repairs or alterations of the system, or discard the system. In other words, the system allows one to know about problems and account for them in a variety of ways.

In some embodiments, the predetermined distance between the target and shooter is 100 yards or 100 meters, although both longer and shorter distances may be used or a combination of different distances may be used. In other embodiments, a target configured for use at a specific distance may also be used at another distance with the point of impact calculated by a multiple of the specified distance.

The present invention provides sets of targets. The sets may contain one or more of a particular target type, as well as providing different target types, such as the various exemplary types described herein. In some embodiments, a first target in the set is configured for zero assessment; a second target in the set is configured to validate accuracy and repeatability of adjustment of elevation adjustment knobs on a scope, and a third target in the set is configured to validate the accuracy and repeatability of adjustments of both elevation and windage.

The sets of targets or individual targets may be provided with instructions for use, including, but not limited, instructions for carrying out any of the methods described herein.

In some embodiments, the target is provided as part of a shooting system. The system may comprise the target and any one or more shooting devices and components, including, but not limited to, a riflescope, a reticle, a firearm, ballistics software, a spotting scope, a cant indicator, a computing device, a laser, night-vision equipment, and a device that measures or calculates an environment condition. Other shooting system components are described in U.S. Pat. Nos. 6,681,512, 6,516,699, 6,453,595, 6,032,374, and 5,920,995, U.S. Pat. Pub. No. 2005/0021282, and pending applications U.S. Ser. No. 10/579,119, 11/389,723, and 60/763,233, herein incorporated by reference in their entireties. The targets of the present invention are configured to work with standard reticles or custom reticles.

The present invention also provides methods of using the targets, sets of targets, and shooting systems of the invention. A variety of methods are described herein, although the present invention is not limited by these methods. Using the targets of the invention, one can take one or more shots to obtain useful information about a shooting system. In some embodiments, one or more shots are taken to assess zero position. In some embodiments, a plurality of shots are taken with different elevation and/or windage adjustments (e.g., using each increment, skipping increments, climbing up, climbing down, jumping back and forth, etc.). In some embodiments, cant is assessed or validated.

The systems and methods of the invention may be used in any desired setting. For example, they may be used on training ranges for recreational or professional use (e.g., police, military, etc.). They may be used of properly calibrate a shooting system. They may be used to train a shooter to better deal with non-linearity or other inherent or acquired problems associated with the shooting system or that are relevant to particular shooting environments or conditions.

DEFINITIONS

As used herein, the term "firearm" refers to any device that propels an object or projectile, for example, in a controllable flat fire, line of sight, or line of departure, for example, handguns, pistols, rifles, shotgun slug guns, muzzleloader rifles, single shot rifles, semi-automatic rifles and fully automatic rifles of any caliber direction through any media. As used herein, the term "firearm" also refers to a remote, servo-controlled firearm wherein the firearm has auto-sensing of both position and directional barrel orientation. The shooter is able to position the firearm in one location, and move to a second location for target image acquisition and aiming. As used herein, the term "firearm" also refers to chain guns, belt-feed guns, machine guns, and Gattling guns. As used herein, the term firearm also refers to high elevation, and over-the-horizon, projectile propulsion devices, for example, artillery, mortars, canons, tank canons or rail guns of any caliber.

As used herein, the term "cartridge" refers, for example, to a projectile comprising a primer, explosive propellant, a casing and a bullet, or, for example, to a hybrid projectile lacking a casing, or, for example, to a muzzle-loaded projectile, compressed gas or air-powered projectile, or magnetic attraction or repulsion projectile, etc. In one embodiment of the present invention, the projectile travels at subsonic speed. In a further embodiment of the present invention, the projectile travels at supersonic speed. In a preferred embodiment of the present invention, the shooter is able to shift between subsonic and supersonic projectiles without recalibration of the scope, with reference to range cards specific to the subsonic or supersonic projectile.

As used herein, the term "target acquisition device" refers to an apparatus used by the shooter to select, identify or monitor a target. The target acquisition device may rely on visual observation of the target, or, for example, on infrared (IR), ultraviolet (UV), radar, thermal, microwave, or magnetic imaging, radiation including X-ray, gamma ray, isotope and particle radiation, night vision, vibrational receptors including ultra-sound, sound pulse, sonar, seismic vibrations, magnetic resonance, gravitational receptors, broadcast frequencies including radio wave, television and cellular receptors, or other image of the target. The image of the target presented to the shooter by the target acquisition device may be unaltered, or it may be enhanced, for example, by magnification, amplification, subtraction, superimposition, filtration, stabilization, template matching, or other means finding use in the present invention. In some embodiments, the target image presented to the shooter by the target acquisition device is compared to a database of images stored, for example, on a medium that is readable by a ballistics calculator system. In this fashion, the ballistics calculator system performs a match or no-match analysis of the target or targets. The target selected, identified or monitored by the target acquisition device may be within the line of sight of the shooter, or tangential to the sight of the shooter, or the shooter's line of sight may be obstructed while the target acquisition device presents a focused image of the target to the shooter. The image of the target acquired by the target acquisition device may be, for example, analog or digital, and shared, stored, archived, or transmitted within a network of one or more shooters and spotters by, for example, video, physical cable or wire, IR, radio wave, cellular connections, laser pulse, optical, 802.11b or other wireless transmission using, for example, protocols such as html, SML, SOAP, X.25, SNA, etc., Bluetooth™, Serial, USB or other suitable image distribution method. With reference to a riflescope, as used herein a "target acquisition device" may function as a fixed target acquisition device, a first focal plane target acquisition device, or a second focal plane target acquisition device.

As used herein, the term "ballistics calculator system" refers to a targeting system that may be, for example, analog or digital, which provides the shooter a solution for the trajectory of a projectile.

As used herein, the term "lens" refers to an object by means of which light rays, thermal, sonar, infrared, ultraviolet, microwave or radiation of other wavelength is focused or otherwise projected to form an image. It is well known in the art to make lenses from either a single piece of glass or other optical material (such as transparent plastic) which has been conventionally ground and polished to focus light, or from two or more pieces of such material mounted together, for example, with optically transparent adhesive and the like to focus light. Accordingly, the term "lens" as used herein is intended to cover a lens constructed from a single piece of optical glass or other material, or multiple pieces of optical glass or other material (for example, an achromatic lens), or from more than one piece mounted together to focus light, or from other material capable of focusing light. Any lens technology now known or later developed finds use with the present invention. For example, any lens based on digital, hydrostatic, ionic, electronic, magnetic energy fields, component, composite, plasma, adoptive lens, or other related technologies may be used. Additionally, moveable or adjustable lenses may be used.

As used herein, the terms "rifleman" and "shooter" refer to any person using the targets of the present invention.

BRIEF DESCRIPTION OF THE FIGURES

FIG. 9 depicts a data card according to an embodiment of the present invention.

FIG. 10 depicts a data card according to an embodiment of the present invention.

DETAILED DESCRIPTION OF THE INVENTION

Figure 1:
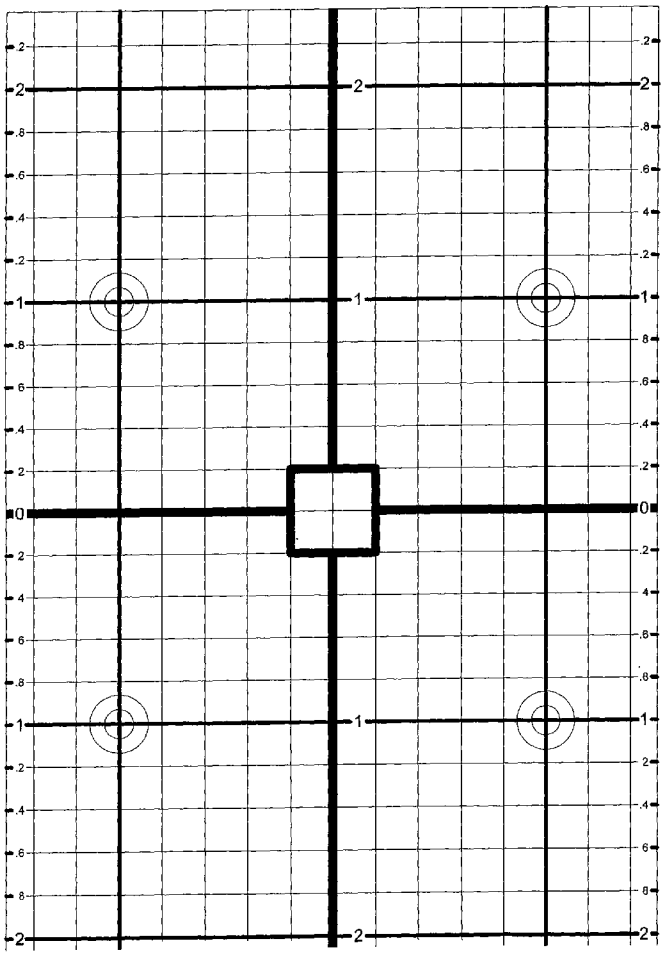
FIG. 1 depicts a target according to an embodiment of the present invention.

Poor shooting is often caused by lack of scope calibration or a failure to otherwise properly set or adjust one or more components of the shooting system that is employed. Poor shooting may also result from a lack of familiarity with a particular shooting system or lack of familiarity under particular shooting conditions, even with a familiar, properly adjusted system. For example, subtle differences even among individual products of a particular model may cause shooting error for a shooter familiar with one specific product. The present invention provides systems and methods that permit proper calibration of shooting systems and that provide training means, allowing a shooter to enhance shooting skills under a variety of conditions (e.g., shooting distances).

The systems and methods of the present invention may be used with a wide variety of shooting systems. Conventional rifles and scopes may be used. Likewise, more complex and advanced shooting systems may be used, including, but not limited to those described in U.S. Pat. Nos. 6,681,512, 6,516,699, 6,453,595, 6,032,374, and 5,920,995, U.S. Pat. Pub. No. 2005/0021282, and pending applications U.S. Ser. No. 10/579,119, 11/389,723, and 60/763,233, herein incorporated by reference in their entireties.

In some embodiments, the targets of the present invention are use to confirm the calibration of a shooting system. To calibrate the shooting system, in some preferred embodiments, the shooter first determines the ballistics based upon the characteristics of the weapon and ammunition to be used. Calibration for range and distance to target can follow many methods. For example, manual methods of calibration require no computer, involve trial and error by the shooter, and provide back up when higher technology-based methods fail or are not available. Computer-based calibration of the target acquisition device and reticle may be performed, for example, on desktop, laptop, and handheld personal computing systems. The systems and methods of the present invention may be used with any such systems for enhanced calibration. In some embodiments, the targets of the present invention are used to calibrate riflescopes that integrate night vision or thermal devices.

When the subject of riflescopes is discussed, the primary focus is on external looks, dimensions, weight, reticle, image resolution, power range, and similar physical characteristics. There is little discussion that evaluates a particular riflescope or discusses studies on a group of a riflescopes and their ability to accurately respond to elevation and windage knob adjustments or other calibrations or settings.

Since long range shooting typically requires elevation and windage adjustments to accurately engage distant targets, it is apparent that a riflescope's elevation and windage adjustment knobs have to yield precise and accurate adjustments. When a shooter engages distant targets and misses, the shooter often blames the ammunition, the rifle, and finally themselves. The riflescope is almost never looked at as contributing to errors. The rifleman often has spent a lot of money on the riflescope. The shooter often falsely assumes that the riflescope is a perfectly calibrated optical instrument for shooting. It is noteworthy to mention that many police departments and military units have never calibrated their tactical riflescopes.

The present invention provides systems and methods that can be provided using affordable materials. These systems and methods permit a shoot to properly calibrate their shooting systems and to master shooting with the calibrated system.

Certain specific embodiments of the invention are described below to illustrate the invention. It should be understood that the invention is not limited to these illustrative embodiments. Skilled artisans will appreciate a wide variety of other variations of the invention based on the description herein and knowledge in the art.

The embodiments described in detail below provide a target specifically designed to be used at 100 yards/meters. It should be understood that any distance may be selected. With the targets of the present invention target, one need not use targets at longer distances (e.g., 500, 1000, 2000 yard/meter, etc.) to calibrate and optimize shooting at the other distances, although use of multiple targets at different distances is contemplated.

While originally developed to permit highly optimized shooting system calibration of elevation and windage adjustments, experiments conducted during the development of the invention demonstrated additional value in identifying and avoiding other problems with (e.g., cant).

To obtain optimal results using the present invention, the firearm should be in good operating condition, should be properly cleaned, and should have all screws tightened to the proper torque, including the scope base and rings, although these are not requirements. In preferred embodiments, ammunition should be selected that consistently shoots 1 MOA (minute of angle) or less (or equivalent), preferably ½ MOA, at 100 yards or 100 meters. The shooter should obtain an accurate muzzle velocity value for the selected firearm and ammunition.

In some embodiments of the present invention, a properly calibrated shooting range is prepared. In some embodiments, the distance from the shooter to the target is either 100 yards or 100 meters. For example, some embodiments of the invention are optimized for use with a standard 100-yard range that is calibrated for shooting in English measurement increments, such as most civilian ranges and many police ranges. Other embodiments of the invention are optimized for use with a standard 100-meter range that is calibrated for shooting in metric measurement increments, such as most military ranges, some police ranges, and many federal agency ranges. The present invention is not limited by the range configuration, however. Any units and any conditions may be employed. For optimal results, the range should be measured precisely. In some embodiments, the range to target is measured from a reference point midway between the middle of the target acquisition device and the firearm muzzle.

After the range is prepared, a target is prepared. In some embodiments of the present invention, the target is positioned at approximately the same distance from the ground as the firearm, and is mounted in a level position. For optimal results, the shooter should assume a firing position that is in an exact straight line perpendicular to the center of the target.

Although the present invention contemplates the use of various types of targets, some embodiments utilize four series of targets that are optimized for particular purposes: (1) zeroing a firearm; (2) validating the accuracy of cant and elevation adjustments of a target acquisition device; (3) validating the accuracy of cant, elevation, and windage adjustments of a target acquisition device; and (4) evaluating, testing, and training of a shooter's sighting skills.

Zeroing Targets

In some embodiments of the present invention, targets are provided that are particularly useful for initial zeroing of a firearm, and for rechecking the zeroing of a firearm. Target acquisition devices such as riflescopes typically have calibration values imprinted on their elevation and windage adjustment knobs. Many riflescopes feature calibration values that are expressed according to the U.S.M.C. MILS or TMOA standards. In some embodiments, a target is provided that features calibration values that correspond to the calibration values of a riflescope.

FIG. 1 depicts an exemplary target that is useful for zeroing a firearm. The target contains one or more primary vertical and horizontal lines arranged in a grid. The grid further contains a plurality of secondary and tertiary vertical and horizontal lines distributed within the primary vertical and horizontal lines of the grid. One or more primary targeting points are located at the intersection of the primary vertical and horizontal lines. One or more secondary targeting points are arranged at intersections of secondary and/or tertiary vertical and horizontal lines within the grid. One or more horizontal lines of the grid are marked with numbers corresponding to calibration values of a riflescope or other target acquisition device.

A firearm may be zeroed using a target of the present invention by firing at least one, and preferably a plurality (e.g., 2, 3, . . . ) rounds of ammunition into the target. The grid of the target is designed to be visible within the distance of the range (preferably 100 yards or 100 meters) with the aid of a typical spotting scope. The scope or other target acquisition device may then be adjusted (e.g., via clicks) based upon the point of impact on the target.

An additional benefit of the present invention is that after zeroing a firearm, the target may be used to provide a record that the firearm has been zeroed. Such verification may be particularly useful to police and federal agencies, if the accuracy of a particular firearm is ever called into question (e.g., in a lawsuit or investigation). In some embodiments, the target provides a predefined zone where relevant data may be recorded, such as information about the shooter, the firearm, the firearm's performance, the range, the ammunition, the environmental conditions, etc.

The present invention may be used to zero firearms for use in long or extreme range shooting (800 meters and beyond). For example, the target may be used to verify the accuracy of a riflescope's elevation adjustments on a 100-meter range. After firing at least one shot to confirm the firearm's zero, an additional shot may be fired after making an elevation adjustment of 1/10 mil (typically, one "click" of the adjustment knob). Subsequent shots may then be fired after subsequent clicks. With a properly zeroed firearm, the target should record points of impact that are vertically aligned and spaced exactly one centimeter (or other relevant unit) apart when measured from the center holes. The zero may then be rechecked by adjusting the scope's elevation knob to its initial position. A properly functioning scope should have a perfect return to zero, although the present invention permits one to better utilize their shooting system, regardless of whether a perfect return to zero is achieved.

Adjustment and Cant Validation Targets

Another embodiment of the present invention provides targets that are useful for validating the accuracy and repeatability of a riflescope's elevation adjustment knob regardless of whether the scope is in the first or second focal plane. The targets are also useful for validating the cant of a firearm, and can additionally be used for zeroing a firearm. Since riflescope adjustment knobs are mechanical devices, they are subject to wear that can result in skipping, failure to move, jumping, sticking, or outright failure of the whole unit. No riflescope, regardless of cost, is immune to problems of some sort. The targets of the present invention are useful for periodically validating the accuracy of a firearm and target acquisition device combination. The targets may also provide a record of the validated performance of a firearm at a particular point in time, which is useful if the accuracy of a particular firearm is ever called into question. The targets also permit the shoot to extend the performance of the shooting system to maximal levels, including levels beyond which the intended design parameters.

Figure 2:
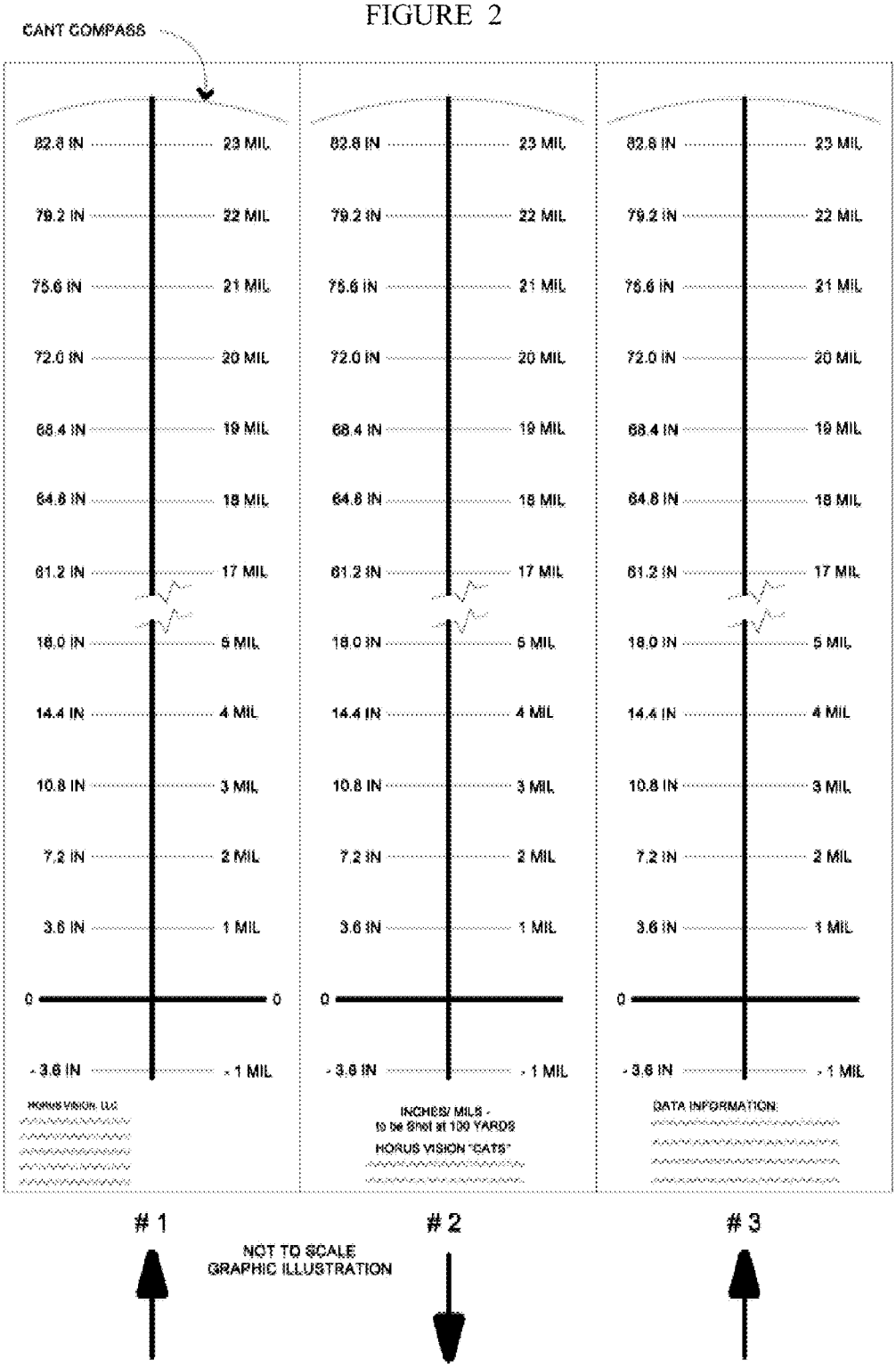
FIG. 2 depicts a target according to an embodiment of the present invention.

FIG. 2 depicts a target that is useful for validating elevation adjustment, cant, and the zero of a firearm. The target is divided into three sections, each of which has an intersecting primary vertical and primary horizontal line. The target has one or more secondary horizontal lines arranged above and below the primary horizontal line. The primary horizontal line is marked with a zero. One or more secondary horizontal lines of the grid are marked with numbers corresponding to incremental elevation adjustment values (e.g., "clicks") of a riflescope or other target acquisition device. For example, for a target calibrated for use with a 100-yard range, the first secondary horizontal line above the primary horizontal line would be marked 3.6 inches on one end of the line, which corresponds to 1 mil, which would be marked on the other end of the line. The second secondary horizontal line above the primary horizontal line would be marked 7.2 inches on one end of the line, and 2 mil on the other end of the line, and so on for the additional lines. The target in FIG. 2 also features a secondary horizontal line below the primary horizontal line, marked −3.6 inches at one end, and −1 mil at the other end. Although FIG. 2 depicts a target calibrated in inches/mils for a 100 yard range, targets may be calibrated in other values, such as metric units, U.S.M.C. MILS, TMOA (true minute of angle), and SMOA (shooters minute of angle).

To validate the accuracy and repeatability of a riflescope's elevation adjustment knob, a shooter first prepares a range at either 100 yards or 100 meters, prepares a target suitable for zeroing a firearm, and establishes a zero for the firearm. Depending on whether the scope is in the first focal (objective) plane, the second focal (ocular) plane, or is a fixed power scope, the shooter may need to determine the exact power setting where the calibration values of the adjustment knobs are valid and true. This setting may be different for each scope, and may generally be determined by reference to the scope's specifications, instruction manual, or manufacturer information.

Figure 3:
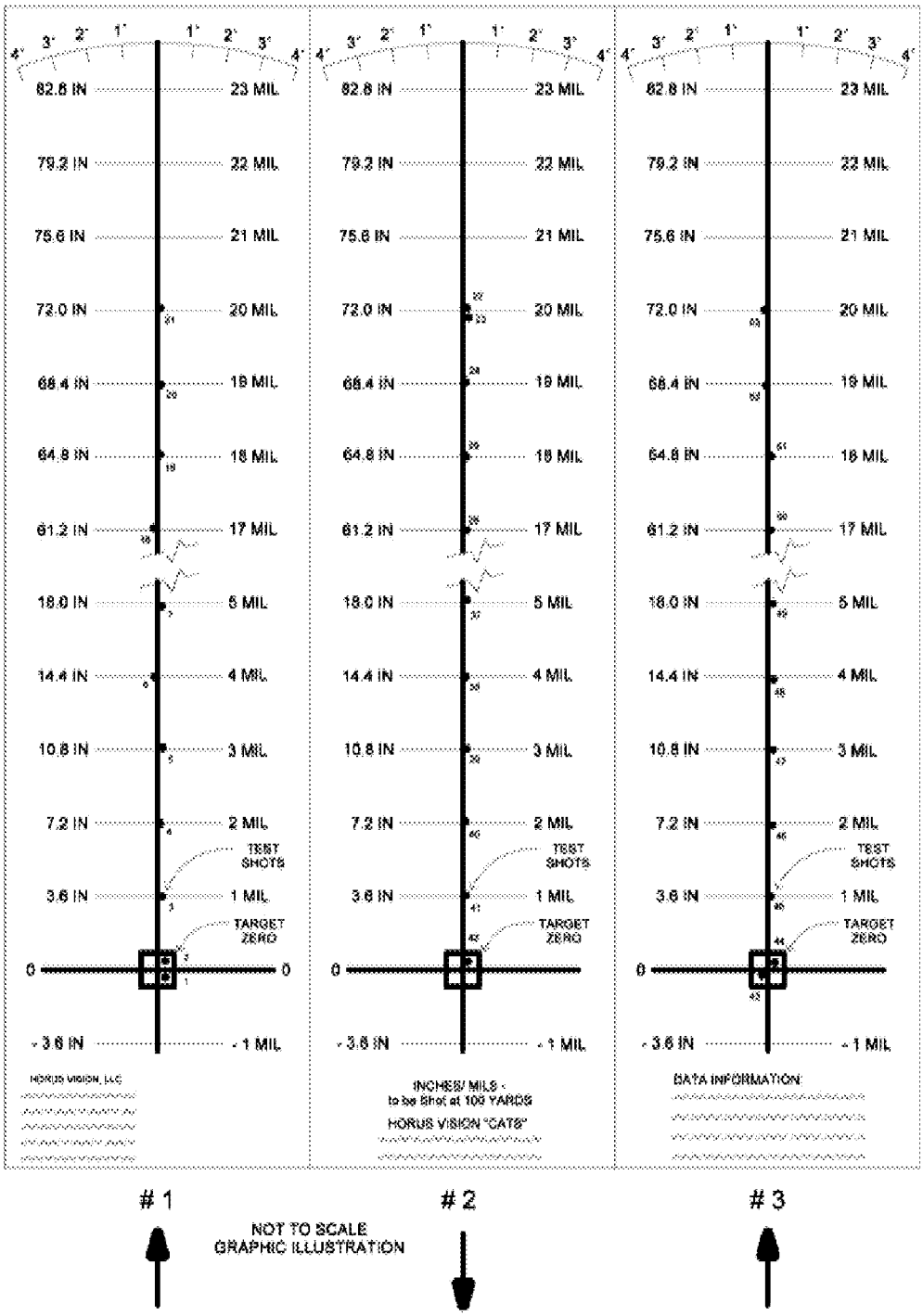
FIG. 3 depicts a target according to an embodiment of the present invention.
Figure 4:
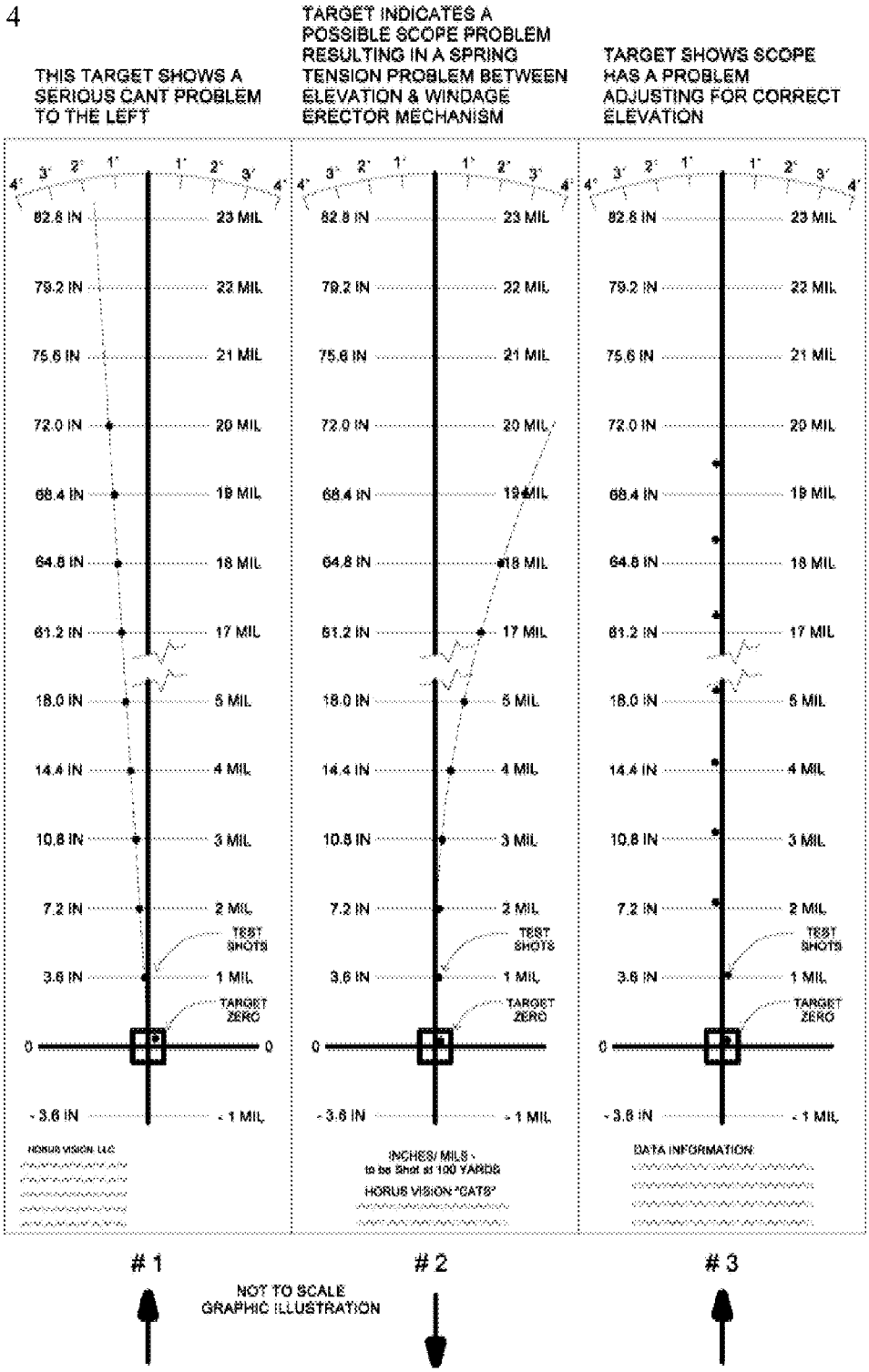
FIG. 4 depicts a target according to an embodiment of the present invention.

In some embodiments the targets of the present invention are used to confirm correct shooting position of a rifleman. The shooter should select a shooting position that provides a solid, repeatable position from which to shoot. The shooter then aligns the vertical and horizontal crosshairs in the riflescope with the primary vertical and horizontal lines of the first of the three sections of the target, which provides a perfect zero on the target. After firing at least one shot to confirm the firearm's zero, an additional shot may be fired after making an elevation adjustment. If using a target calibrated in true minute of angle (TMOA), each adjustment should be 5 MOA. If using a target calibrated in U.S.M.C. Mils, each adjustment should be 1 Mil. Subsequent shots may then be fired after subsequent adjustments. To insure repeatability, all shots should be fired using the same method of aligning the vertical and horizontal crosshairs in the riflescope with the primary vertical and horizontal lines of the target. After the scope has reached its upper elevation adjustment limit, the shooter then switches to the second (middle) section of the target, and repeats the procedure in reverse, lowering the elevation adjustment for each subsequent shot. When the shooter reaches the zero point of the second section, the procedure used for the first section may then be repeated in the third section of the target. After the procedure is complete, the shooter may record relevant data in the space provided on the target, such as information about the shooter, the firearm, the firearm's performance, the range, the ammunition, the environmental conditions, etc. FIG. 3 and FIG. 4 depict sample results of the procedure.

The targets are also useful for identifying whether a particular firearm has a cant problem. Cant occurs when a rifle is not held vertically. On scoped long-range rifles, the problem is exacerbated. Cant may be caused by a variety of conditions. For example, the center of the scope may not be perpendicular to the bore of the rifle, the scope base and rings may be slightly off center, the bore of the barrel and the action may be off center, and the vertical crosshair may not be exactly perpendicular to the rifle bore. The targets of the present invention are designed to show the maximal lateral displacement based on a given elevation selection. The lateral distance shown on the target provides feedback information to correct the cant. By correcting cant, the shooter can eliminate the lateral movement displacement and also any vertical displacement.

Figure 5:
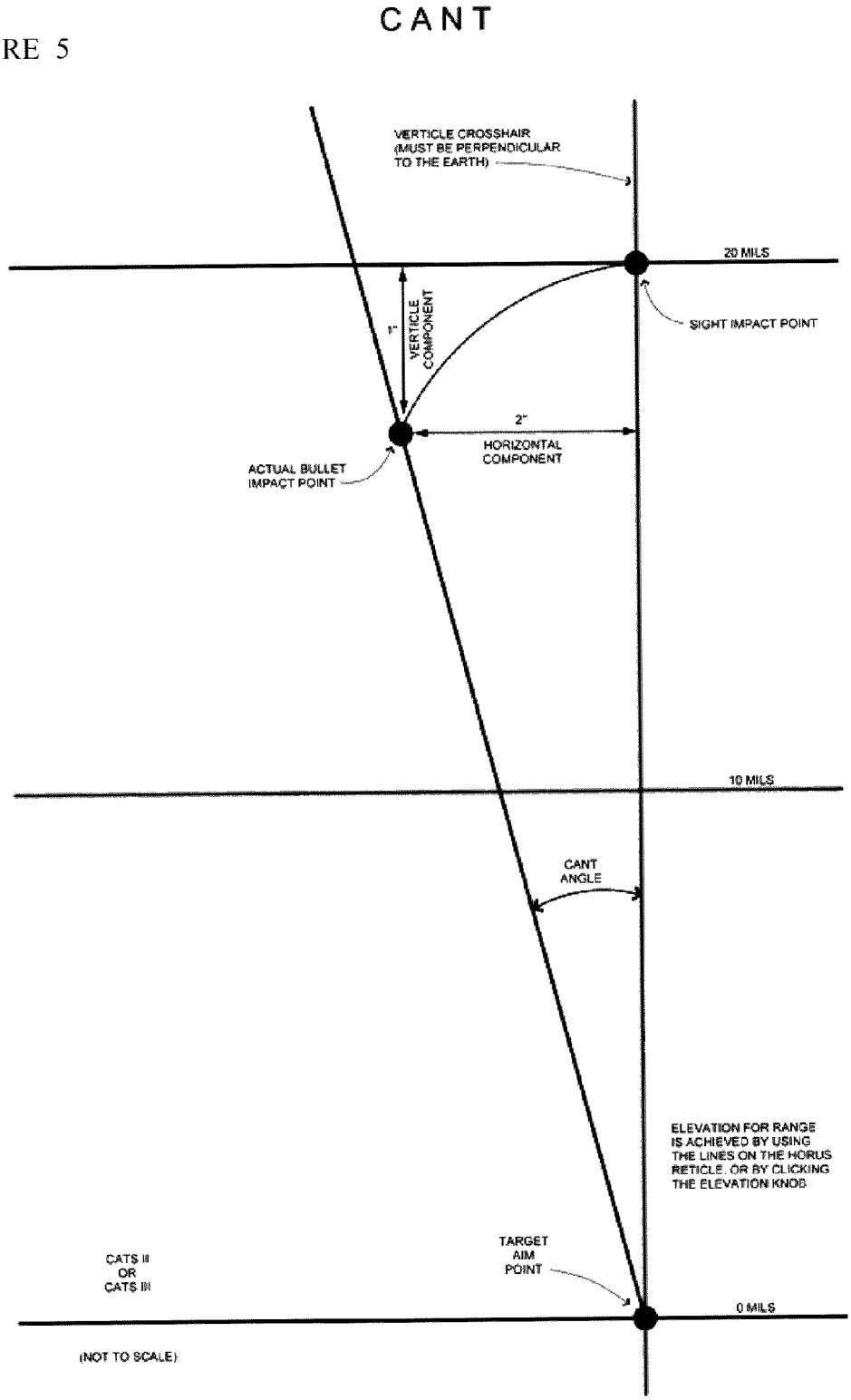
FIG. 5 depicts a close-up view of a target according to an embodiment of the present invention.

After completing a target shooting session according to the above procedure, the shooter may examine the target for an analysis of problems. In each of the three sections of the target, a line may be drawn connecting the bullet impact points to the intersection of the primary vertical and horizontal lines. If all of the impact points are located on the primary vertical line, then the firearm does not have a cant problem. However, if the impact points form a line curving to either side of the primary vertical line, then a cant error exists. The precise number of degrees of cant error may be determined by extending the line connecting the impact points all the way to the curved line at the top of each section of the target, as shown in FIG. 4. FIG. 5 shows a close-up view of a section of a target indicating a cant error.

If an analysis of the target indicates a cant error, the error may be corrected by loosening the scope rings, rotating the scope in the opposite direction of the cant shown on the target, and re-tightening the scope rings. The firearm should then be re-zeroed using the zeroing procedure of the present invention. After zeroing, the cant should be retested using the above procedure. If a cant error persists, repeat the procedure of rotating the scope in the opposite direction of the cant shown on the target, re-zero the firearm, and then retest for cant error. This procedure may be repeated until the target indicates no cant error.

Elevation Adjustment, Windage Adjustment, and Cant Validation Targets

An additional embodiment of the present invention provides targets that are useful for validating the accuracy and repeatability of both elevation and windage adjustments on a rifle scope. The targets are also useful for measuring the cant of a firearm. Use and analysis of the targets further provides a highly effective method of instruction and skills training in the art of long range target shooting.

A primary benefit of the targets of the present invention is that they enable shooters to evaluate both their equipment and their techniques for short, medium, long, or extreme range target shooting using a standard 100-yard or 100-meter range. In addition, shooters can use the targets to readily identify both singular and compound problems related to poor shooting techniques, improper use of the optics, cant, or weapon problems. A further benefit is that the targets can be used to establish a "point of failure" for a particular firearm and target acquisition device combination. A "point of failure" is established when the elevation and windage adjustments pass the norms for proper calibration. A shooter can validate a weapon's ability to properly track up to the point of failure. Beyond the established point of failure, a shooter's ability to make accurate shots decreases. A shooter's ability to engage long-range targets is determined by his scope's ability to yield accurate elevation and windage adjustment. Accurate mounting of the riflescope to eliminate cant is also very important for extreme long-range shots.

Figure 6:
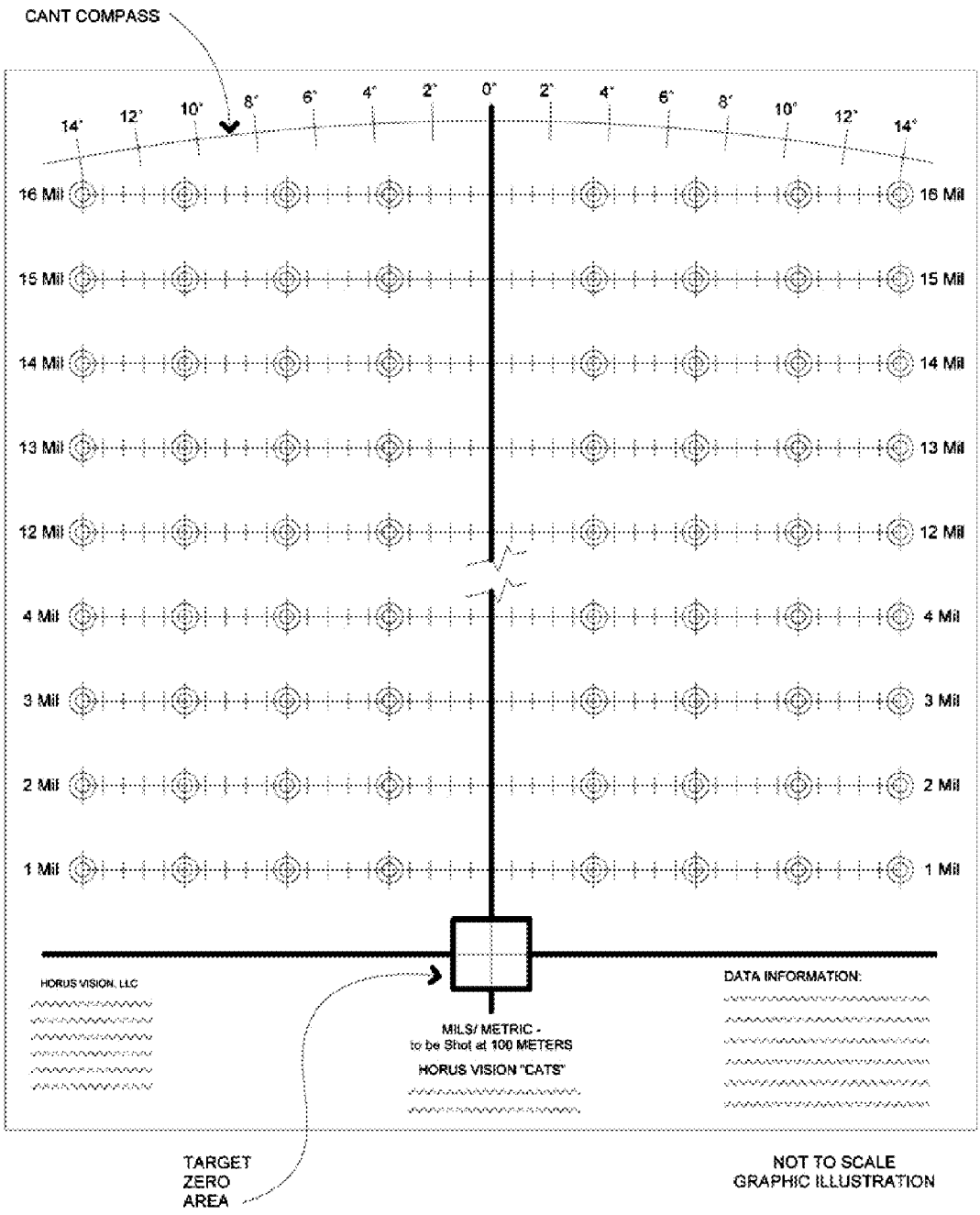
FIG. 6 depicts a target according to an embodiment of the present invention.

FIG. 6 depicts a target useful for validating elevation adjustments, windage adjustments, and cant on a riflescope. The target features an intersecting primary vertical line and primary horizontal line. One or more parallel secondary horizontal lines are arranged above the primary horizontal line.

Figure 7:
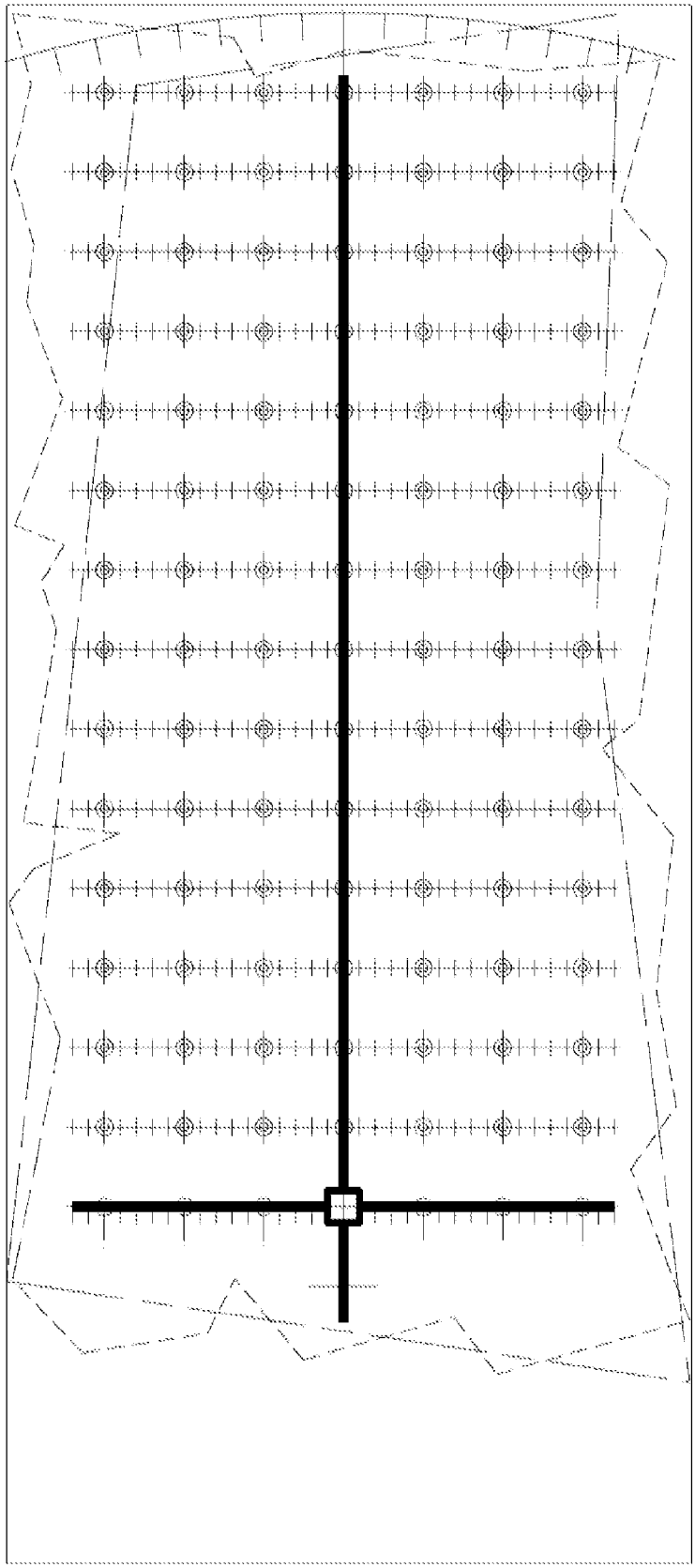
FIG. 7 depicts a target according to an embodiment of the present invention.

One or more secondary vertical lines intersect the secondary horizontal lines. A primary targeting point is located at the intersection of the primary vertical and horizontal lines. One or more secondary targeting points are arranged at intersections of secondary vertical and horizontal lines. One or more horizontal lines of the grid are marked with numbers corresponding to calibration values of a riflescope or other target acquisition device. A curved horizontal line representing a cant compass is arranged along the top portion of the target. The curved line is intersected by a plurality of vertical lines marked with numbers corresponding to degrees of cant. The target depicted in FIG. 6 contains values calibrated in U.S.M.C. Mils, for use on a 100-meter range. FIG. 7 depicts a similar target, but designed for use with scopes that are calibrated in TMOA, for use on a 100-yard range.

The thickness of the secondary target lines is configured such that while they are clearly visible at close range, they cannot be visually perceived at 100 meters or 100 yards when looking through the scope to be calibrated. Because the secondary lines cannot be seen from the shooter's vantage point, the shooter cannot rely on them as a targeting aid, and thus is forced to use only the crosshair of the primary vertical and horizontal lines. All targeting adjustments must therefore be made using only the scope's elevation and windage knobs. Alternatively, if the shooter is using a target acquisition device that features secondary aiming points, such as the devices of U.S. Pat. Nos. 6,681,512, 6,516,699, 6,453,595, 6,032,374, and 5,920,995 to Sammut, the shooter may additionally rely on optical adjustments. Regardless of the type of target acquisition device used, the target forces the shooter to rely solely upon the target acquisition device, rather than the target itself. The light secondary lines eliminate a shooter's natural inclination to consciously or unconsciously "compensate" to gain the desired results.

To validate the accuracy and repeatability of a riflescope's elevation and windage adjustment knob, a shooter first prepares a range at either 100 yards or 100 meters, prepares a target suitable for zeroing a firearm, and establishes a zero for the firearm.

The shooter should select a shooting position that provides a solid, repeatable position from which to shoot. The shooter then aligns the vertical and horizontal crosshairs in the riflescope with the primary vertical and horizontal lines of the target, which provides a perfect zero on the target. At least one shot should be fired to confirm the zero of the firearm. If the firearm does not have a perfect zero, the shooter should re-zero the firearm before proceeding. After the zero has been confirmed, the shooter may fire additional shots after making elevation and windage adjustments. The following is an example of a test sequence that may be used, although the present invention contemplates the use of any sequence of shots.

1. Fire two shots to confirm the weapon is coordinated with the target zero point. One should have a perfect zero to continue. If there is not perfect zero, Stop, RE-ZERO the rifle.
2. a. Use the intersection of the Main Vertical and Main Horizontal Crosshair as the primary targeting point.
   b. Do not adjust the elevation knob (zero set at 100)
   c. Move windage 2 Mils to R; fire 1 shot.
   d. Move windage 4 Mils to R; fire 1 shot.
   e. Move windage 2 Mils to L; fire 1 shot.
   f. Move windage 4 Mils to L; fire 1 shot.
3. a. Adjust the elevation knob 2 Mils up. Remember all adjustments for windage and elevation are made by adjusting the scope's elevation and windage adjustment knobs.
   b. Move windage 2 Mils to R; fire 1 shot.
   c. Move windage 4 Mils to R; fire 1 shot.
   d. Move windage 2 Mils to L; fire 1 shot.
   e. Move windage 4 Mils to L; fire 1 shot.
4. a. Using only the elevation and windage knobs at each elevation of 4 Mils, 8 Mils, 10 Mils, 12 Mils, 14 Mils, and 16 Mils,
   b. Fire the following windage sequence:
      i. Move windage 2 Mils to R; fire 1 shot.
      ii. Move windage 4 Mils to R; fire 1 shot.
      iii. Move windage 2 Mils to L; fire 1 shot.
      iv. Move windage 4 Mils to L; fire 1 shot.

Figure 8:
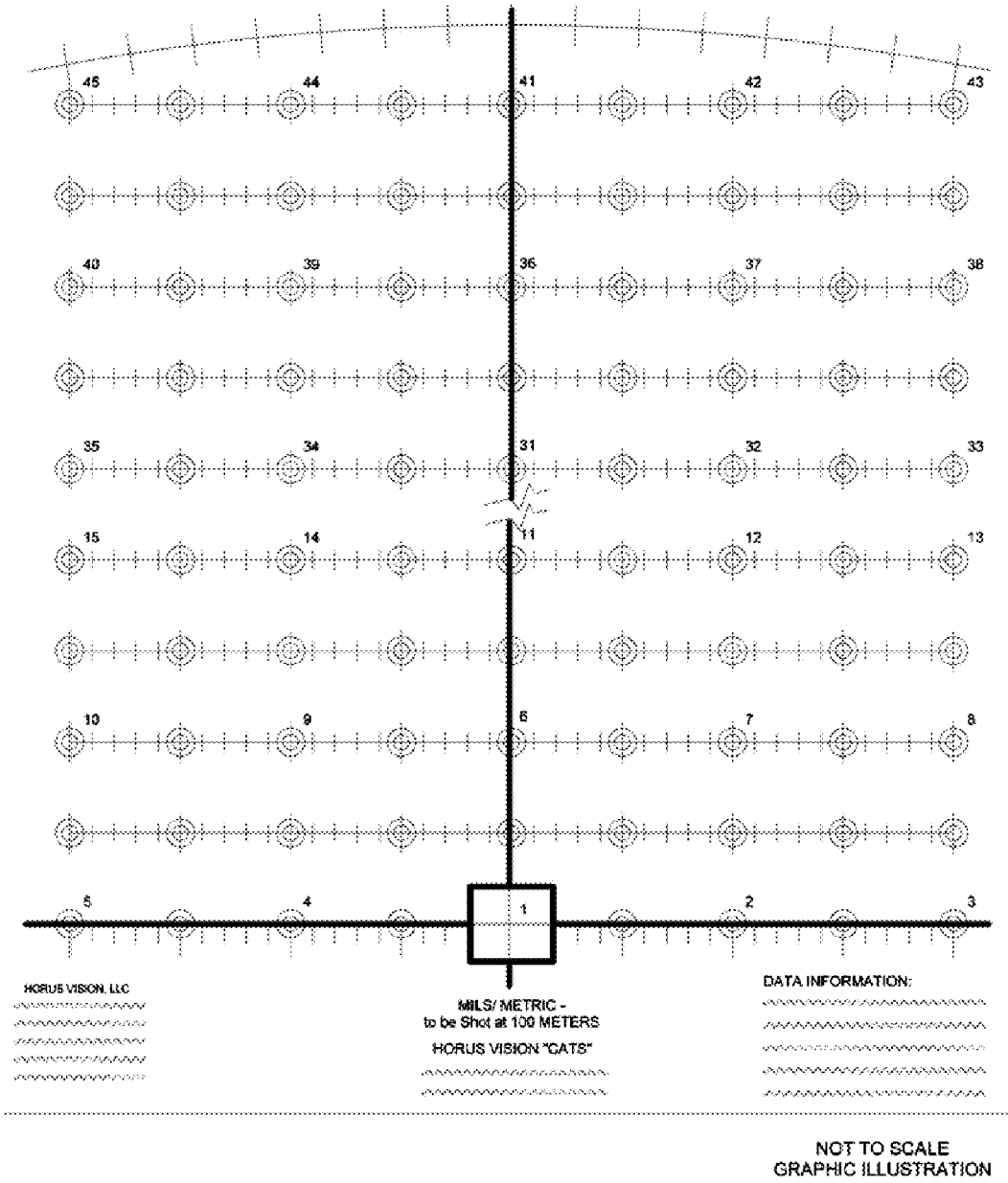
FIG. 8 depicts a target according to an embodiment of the present invention.

FIG. 8 depicts a sample target displaying the above firing sequence. A written record of the firing sequence used by a shooter may be created to enable reproduction of the sequence at a later time. FIGS. 9 and 10 depict sample data cards upon which firing sequences could be recorded for future reference.

The present invention provides a novel means of analyzing and improving a shooter's skills, and is equally useful for beginners, novices, and experienced shooters. Since the targets of the present invention allow for the live fire simulation of long range shooting on a standard 100-yard or 100-meter range, down range environmental factors that may influence bullet performance are eliminated. This allows the shooter to evaluate performance based solely upon shooting technique and the equipment itself. When a target of the present invention is properly mounted and placed at exactly 100 yards/meters, it represents a highly calibrated window located between the gun and the theoretical long-range target. This window allows the shooter to evaluate the accuracy of his performance since the exact point of bullet impact on the target can be recorded and analyzed. If the point of impact is off at 100 yards/meters, then it will be off by a determinable linear amount as the range increases. The following table illustrates how shooting results at 100 yards can be used to project results at greater distances.

| Actual inches off center by live fire at 100 yards | Inches off center at 500 yards | Inches off center at 1000 yards | Inches off center at 1500 yards | Inches off center at 2000 yards |
|---|---|---|---|---|
| 0 | 0 | 0 | 0 | 0 |
| 1.0 | 5.0 | 10.0 | 15.0 | 20.0 |
| 2.0 | 10.0 | 20.0 | 35.0 | 40.0 |
| 3.0 | 15.0 | 30.0 | 45.0 | 60.0 |

The systems and methods of the present invention may be used in any combination for practice, evaluation, and training in the field of short, medium, long, and extreme range target shooting. The following is an illustrative training routine, using targets calibrated in U.S.M.C. Mils and a riflescope with elevation and windage turret knobs calibrated in Mils.

1. Set up the target as recommended.
2. Use the exact shooting position that would normally be used for most long-range shots. For large caliber guns, a standing bench-rest position that allows one to get directly behind the gun in a comfortable position enables one to easily handle heavy recoil.
3. Establish a "Data Card" with a shooting sequence, elevation, and windage values.
4. With best shooting technique, engage the target. Follow the shooting sequence that has been outlined. At any point during the shooting sequence, one can stop and check the target and critique the shooting performance. Note: If one is unable to shoot at a consistent 1 MOA level or less, stop. Re-evaluate shooting and/or scope technique. Make the changes that one believes will yield the desired results. Cover the holes in the target or use a new target. Once again, engage the target. Start the shooting sequence outlined on the data card.

5. A perfect shooting performance requires all target points listed on the data card to show sub ½ MOA shot placement. A consistent sub ½ MOA performance is extremely difficult. Realistically, when one achieve a goal of 1 MOA or less for each of the targeting points on the Series III target, one can increase the level of difficulty. Below are some recommended methods to improve skills. Other methods may be employed.
   a. Establish an elapsed time to shoot the firing sequence shown on the data card. Work against this time criteria while trying to improve accuracy.
   b. Speed drills: Set an unrealistically short time to complete the entire firing sequence on the data card. Force oneself to use this time frame.
   c. Shoot at different times of the day. The sun will be in different positions relative to the target. Try shooting at dawn and dusk under twilight conditions. This causes the shooter to discover that light is a critical factor in proper shot placement.
   d. Shoot at night: Try lighting the target from different positions. Place a light bulb directly in front of the target. Try placing the single light to the side (90 degrees) of the target. Try illuminating the target with a spotlight placed behind the shooter. Use night vision devices attached to the scope.
   e. Repeat any one or more of the above techniques, or other techniques, with different equipment or shooting accessories or shooting techniques.

Figure 11:
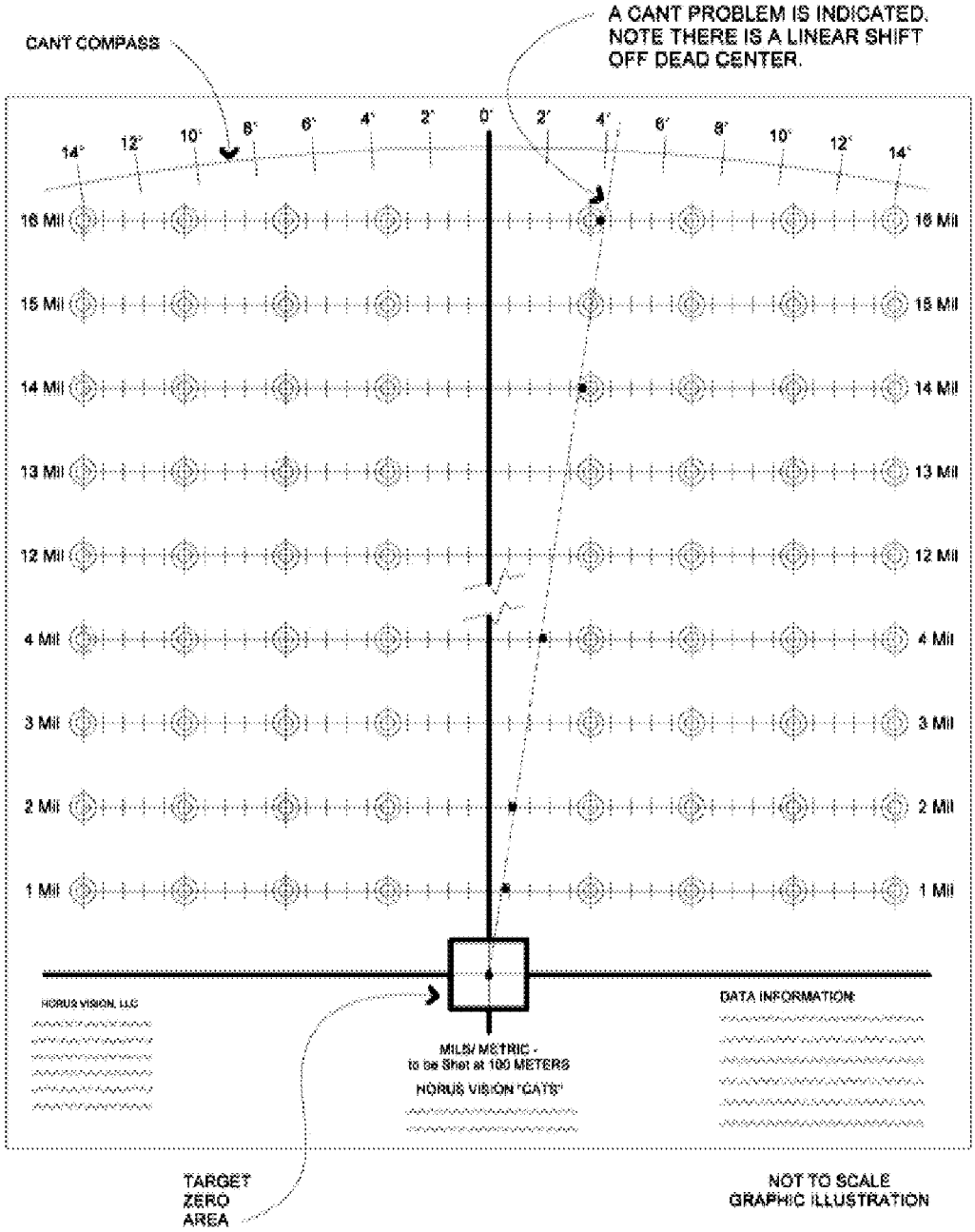
FIG. 11 depicts a target according to an embodiment of the present invention.
Figure 12:
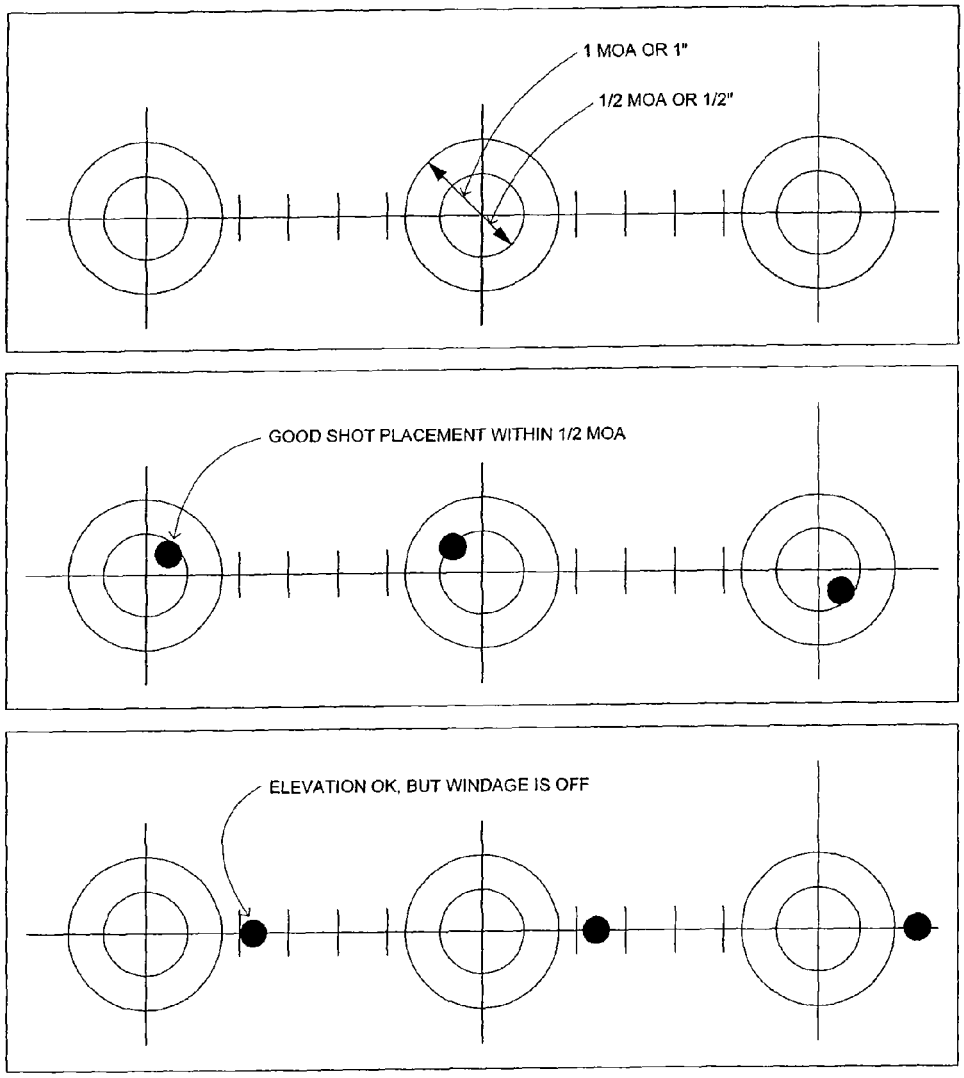
FIG. 12 depicts a close-up view of a target according to an embodiment of the present invention.
Figure 13:
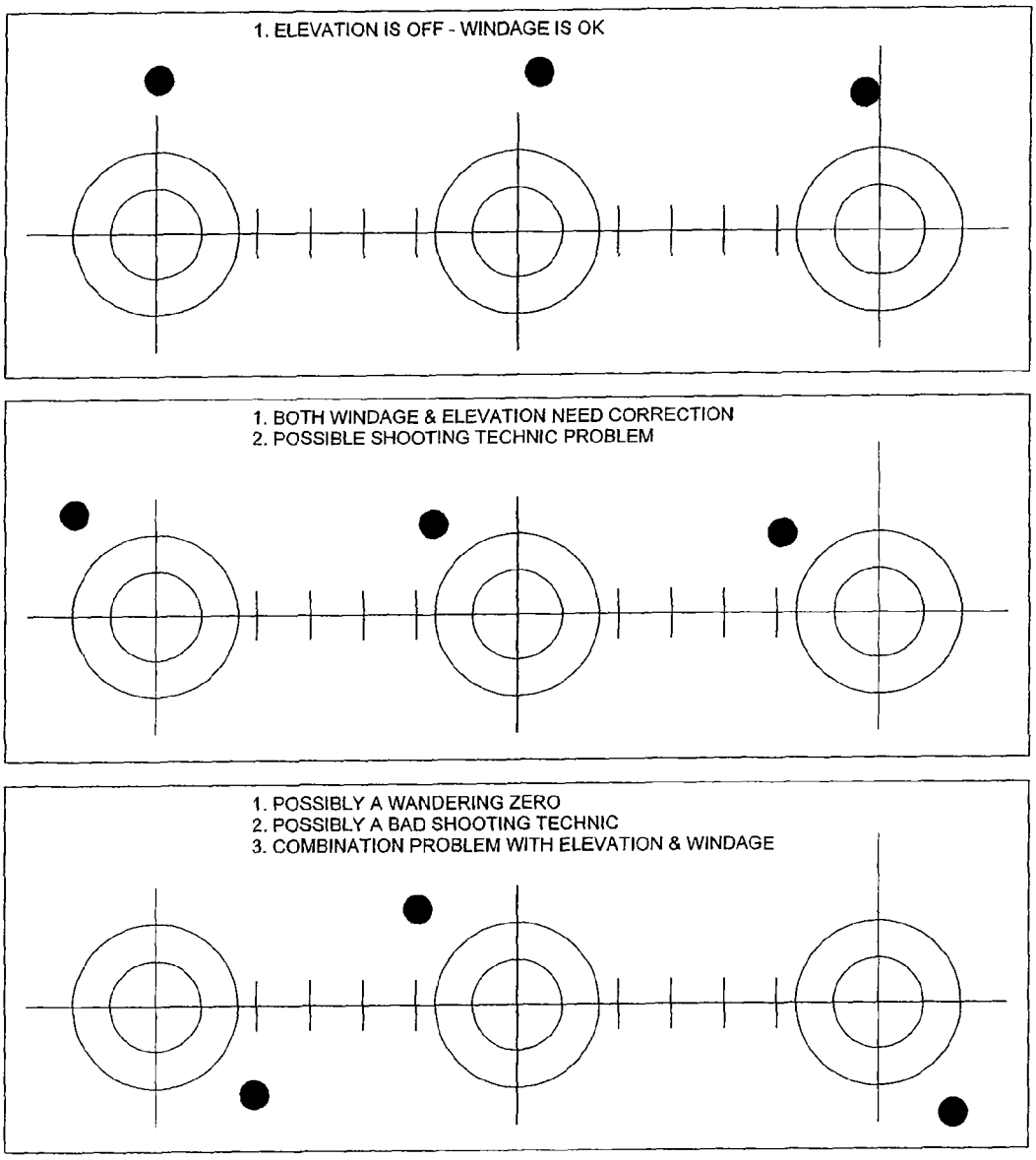
FIG. 13 depicts a close-up view of a target according to an embodiment of the present invention.

Accurate long range shooting involves numerous factors including shooting technique, gun specifics, ammunition, sighting systems, and environmental factors. By using the targets of the present invention at exactly 100 yards/meters, specific factors such as gun specifics, ammunition, and environmental conditions become "constants" because of the short range. In other words, these factors will have little or no effect at 100 yards/meters once a perfect zero is established. FIGS. 11, 12, and 13 depict how the targets of the present invention may be analyzed to evaluate and improve shooting performance.

The targets of the present invention become a valuable instructional tool because the shooting instruction can focus specifically on shooting technique and the sighting system. The targets also provide the ability to instruct shooters in the proper use of anti-cant devices, such as scope levels, the MGW Bubble Level, and the Horus Vision ASLI. The use of anti-cant device can improve performance on every shot. Suggested training techniques include having an instructor call shot coordinates to a student, who then immediately engages the target, and having an instructor state a range to a student, who then calculates the hold and engages the target.

Anti-Cant Targets

Another embodiment of the present invention provides targets that are useful for evaluating a shooter's general skills and skills at using anti-cant devices. Use and analysis of the targets further provides a highly effective method of instruction and skills training in the art of long range target shooting.

Figure 14:
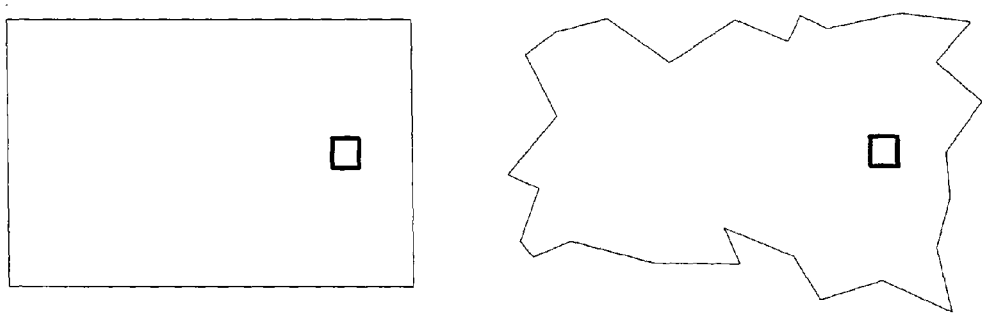
FIG. 14 depicts two targets according to an embodiment of the present invention.

FIG. 14 depicts a target useful for both general skill evaluation and anti-cant effectiveness. The target is depicted as seen at 100 yards/meters. The thickness of all of the target lines is such that while they are clearly visible at close range, they cannot be visually perceived at 100 meters or 100 yards when looking through a scope. Because the lines cannot be seen from the shooter's vantage point, the shooter cannot rely on them as a targeting aid, and thus is forced to use only the square targeting box. All targeting adjustments must therefore be made using only the scope's elevation and windage knobs. The target is designed to challenge the individual shooter's proficiency and/or to test the abilities of newly minted long range shooters. To obtain a high number of well-placed shots, the shooter must be extremely well versed and perfect in shooting technique, and must additionally possess a complete mastery of the riflescope. To further complicate and increase the level of difficulty, the shooter must rely on an anti-cant device. FIG. 14 further depicts a target that has been cut along a pre-printed dotted pattern along the edges. Cutting the target in this manner removes any vertical or horizontal reference points for the shooter to use when engaging the target, which further increases the required skill level.

Ranging Targets

In some embodiments, shapes of specified dimension (e.g., circles, squares, triangles, bars, dots, or rectangles, and combinations thereof at one or more orientations) are provided in at least one zone of the targets of the present invention. In some embodiments, the shapes are provided with identifying markings. With knowledge of the dimensions of the specified shape, and a shooting system calibrated for use with the targets of the present invention at a specified distance (e.g., 100 yards), the range to the target at distances other than 100 yards may be determined. For example, if it is known that a specified bar is 48 inches in length on a target of the present invention, and that it subtends 2 MILS on a riflescope configured for use with a target of the present invention at 100 yards at a distance other than 100 yards, then the range to the target is 666 yards i.e.:

$$[(48/36)\times 1000 \text{ yards}]/2 \text{ MILS}=666 \text{ yards}$$

Similarly, if the line is 13 inches in length on a target of the present invention, and it subtends 2 MILS on a riflescope configured for use with a target of the present invention at a distance other than 100 yards, then the range to the target is 180.5 yards i.e.:

$$[(13/36)\times 1000 \text{ yards}]/2 \text{ MILS}=180.5 \text{ yards}$$

Use such a system trains the shooter to use a diversity of different reference points to assess distance.

All publications and patents mentioned in the above specification are herein incorporated by reference. Various modifications and variations of the described compositions and methods of the invention will be apparent to those skilled in the art without departing from the scope and spirit of the invention. One skilled in the art will recognize at once that it would be possible to construct the present invention from a variety of materials and in a variety of different ways. Although the invention has been described in connection with specific preferred embodiments, it should be understood that the invention should not be unduly limited to such specific embodiments. While the preferred embodiments have been described in detail, and shown in the accompanying drawings, it will be evident that various further modification are possible without departing from the scope of this invention.

It is claimed:

1. A method for shooting calibration, comprising:

a.) providing a target comprising markings configured to assess:

i.) initial zeroing of a firearm;

ii.) accuracy of a plurality of elevation adjustments at a predetermined distance from the shooter; and iii.) markings configured to assess cant; and b.) shooting at said target with a firearm.

2. The method of claim 1, wherein a plurality of shots are taken.

3. The method of claim 2, wherein at least one of said plurality of shots is taken to assess zero position.

4. The method of claim 2, wherein at least two of said plurality of shots are taken with different elevation adjustments.

5. The method of claim 2, wherein at least two of said plurality of shots are taken with different windage adjustments.

6. The method of claim 2, wherein said plurality of shots comprises a series of shots of increasing elevation adjustments, followed by a series of shots of decreasing elevation adjustments.

7. The method of claim 2, wherein cant is validated after said shots are taken.

8. The method of claim 2, wherein results of said shots are recorded.

9. The method of claim 8, wherein information about said firearm or shooter is further recorded.

10. The method of claim 1, wherein said target is placed at said predefined range from a shooter at a target range.

11. The method of claim 10, wherein said target range employs a plurality of said targets.

12. A method for shooting calibration, comprising:

a.) providing a target, comprising:

i.) two or more zones, each of said two or more zones having markings configured to assess accuracy of a plurality of elevation adjustments of a target acquisition device at a single predetermined distance from the shooter; and ii.) markings configured to assess cant; and b.) shooting at said target with a firearm.

13. A method for shooting calibration, comprising:

a.) providing a target comprising markings configured to assess:

i.) initial zeroing of a firearm;

ii.) accuracy of a plurality of elevation adjustments at a predetermined distance from the shooter; and iii.) one or more markings that define a bull's-eye wherein said markings comprise primary vertical and horizontal lines intersecting on said target, and a plurality of secondary horizontal lines at defined unit increments above and below said primary horizontal lines, said increments defined by said elevation adjustments, and wherein a plurality of said bull's-eye markings are positioned at predefined distances along said secondary horizontal lines; and b.) shooting at said target with a firearm.

14. The method of claim 1, claim 12 or claim 13, wherein said target has an external shape that is not square or rectangular.

15. The method of claim 14, wherein said external shape comprises a plurality of edges that are not parallel or perpendicular with any other edge.

16. A set of targets comprising two or more targets comprising markings configured to assess:

a.) initial zeroing of a firearm;

b.) accuracy of a plurality of elevation adjustments at a predetermined distance from the shooter; and c.) markings configured to assess cant.

17. A shooting system, comprising:

a.) a target comprising markings configured to assess:

i.) initial zeroing of a firearm;

ii.) accuracy of a plurality of elevation adjustments at a predetermined distance from the shooter; and iii.) markings configured to assess cant; and b.) one or more shooting devices and components.

18. The system of claim 17, wherein said one or more shooting devices and components are selected from the group consisting of: a riflescope, a reticle, a firearm, ballistics software, a spotting scope, a cant indicator, a computing device, a laser, night-vision equipment, and a device that measures or calculates an environment condition.

* * * * *